US007746006B2

(12) United States Patent
Liang et al.

(10) Patent No.: US 7,746,006 B2
(45) Date of Patent: Jun. 29, 2010

(54) PROTECTION ARCHITECTURE FOR MULTI-LAMP SYSTEM

(75) Inventors: Shih An Liang, Taoyuan Hsien (TW); Kuo Hei Lee, Taoyuan Hsien (TW); Ken Chuan Hsu, Taoyuan Hsien (TW); Chien Chih Cher, Tainan County (TW)

(73) Assignee: FSP Technology Inc., Taoyuan Hsien (TW)

( * ) Notice: Subject to any disclaimer, the term of this patent is extended or adjusted under 35 U.S.C. 154(b) by 253 days.

(21) Appl. No.: 11/907,918

(22) Filed: Oct. 18, 2007

(65) Prior Publication Data

US 2009/0102392 A1 Apr. 23, 2009

(51) Int. Cl.
*G05F 1/00* (2006.01)

(52) U.S. Cl. ..... 315/307; 315/291; 315/308

(58) Field of Classification Search ..... 315/86–91, 315/119–122, 137–142, 144, 146, 177, 185 R, 315/246, 250, 254, 255, 257, 258, 276–279, 315/282, 283, 291, 312

See application file for complete search history.

(56) References Cited

U.S. PATENT DOCUMENTS

2006/0038508 A1 * 2/2006 Lin et al. ..... 315/276

FOREIGN PATENT DOCUMENTS

TW 1243629 B 11/2005

* cited by examiner

*Primary Examiner*—Douglas W Owens
*Assistant Examiner*—Jianzi Chen
(74) *Attorney, Agent, or Firm*—Muncy, Geissler, Olds & Lowe, PLLC

(57) ABSTRACT

The present invention discloses a protection architecture for a multi-lamp system, which applies to a multi-lamp driving system for driving a plurality of lamp loops. The present invention is characterized in that two opposite-phase loads of a loop are separately defined to be a first load and a second load, and that a voltage-division/detection loop is formed via cascading a first voltage-division element to a second voltage-division element and is coupled to between the first load and the second load to detect an abnormal current, wherein the second voltage-division element is coupled to a ground terminal, and wherein a signal-acquiring terminal is coupled to between the first voltage-division element and the second voltage-division element and acquires an abnormal voltage signal for a protection unit from the abnormal current, and wherein the protection unit detects the abnormal voltage signal and shuts off the driving system.

17 Claims, 5 Drawing Sheets

PROTECTION ARCHITECTURE FOR MULTI-LAMP SYSTEM

FIELD OF THE INVENTION

The present invention relates to a protection architecture for a multi-lamp system, particularly to a protection circuit for a multi-lamp driving system.

BACKGROUND OF THE INVENTION

LCD (Liquid Crystal Display) is extensively used nowadays, and various backlight modules are also developed to illuminate LCD. The lamps of a backlight module are also continuously increased to provide sufficient illumination for the persistently-increasing size LCD. Thus, there are many types of multi-lamp backlight modules and multi-lamp driving systems developed. A R.O.C. patent No. I243629 disclosed a "Multi-Lamp Driving System", which uses a plurality of AC voltage sources and a multi-phase transformer having a plurality of different-phase coil windings to drive a plurality of loads, wherein the currents passing through the loads have an identical value. As shown in FIG. 11, FIG. 15 and FIG. 16 of the prior art patent, lamps are cascaded to form a loop, and several loops can be further connected in parallel to obtain various lamp arrangements. However, this prior art lacks a protection measure for an open loop or a broken lamp. Once one of the lamps is broken or dropped, the driving system will have an imbalanced power distribution, which will result in abnormal current and brightness in some lamps. The lamps having too high a current may deteriorate in advance and consume too much power. Therefore, it is desirous to have a detection/protection mechanism to detect dropped or broken lamps and prevent from imbalanced power distribution.

SUMMARY OF THE INVENTION

The primary objective of the present invention is to provide a protection architecture, which can detect lamp malfunction and protect a multi-lamp system, to solve the problems of the conventional multi-lamp driving system.

The present invention proposes a protection architecture for a multi-lamp system, which applies to a multi-lamp driving system. The multi-lamp driving system comprises: a plurality of AC voltage sources outputting several different-phase voltage signals, a multi-phase transformer having a plurality of different-phase coil windings, and a plurality of loads, wherein at least two opposite-phase loads form a loop, and each AC voltage source drives at least one loop. The protection architecture of the present invention applies to the abovementioned multi-lamp driving system and is characterized in that two opposite-phase loads are separately defined to be a first load and a second load, and that a voltage-division loop is coupled to between the first load and the second load to detect an abnormal current. The voltage-division loop is formed via cascading a first voltage-division element to a second voltage-division element, and the second voltage-division element is connected to a ground terminal. A signal-acquiring terminal is coupled to between the first voltage-division element and the second voltage-division element and acquires an abnormal voltage signal from the abnormal current and transfers the abnormal voltage signal to a protection unit. Then, the protection unit detects the abnormal voltage signal and shuts off the driving system.

DETAILED DESCRIPTION OF THE PREFERRED EMBODIMENTS

The technical contents of the present invention will be described in detail in cooperation with the drawings below.

Figure 1:
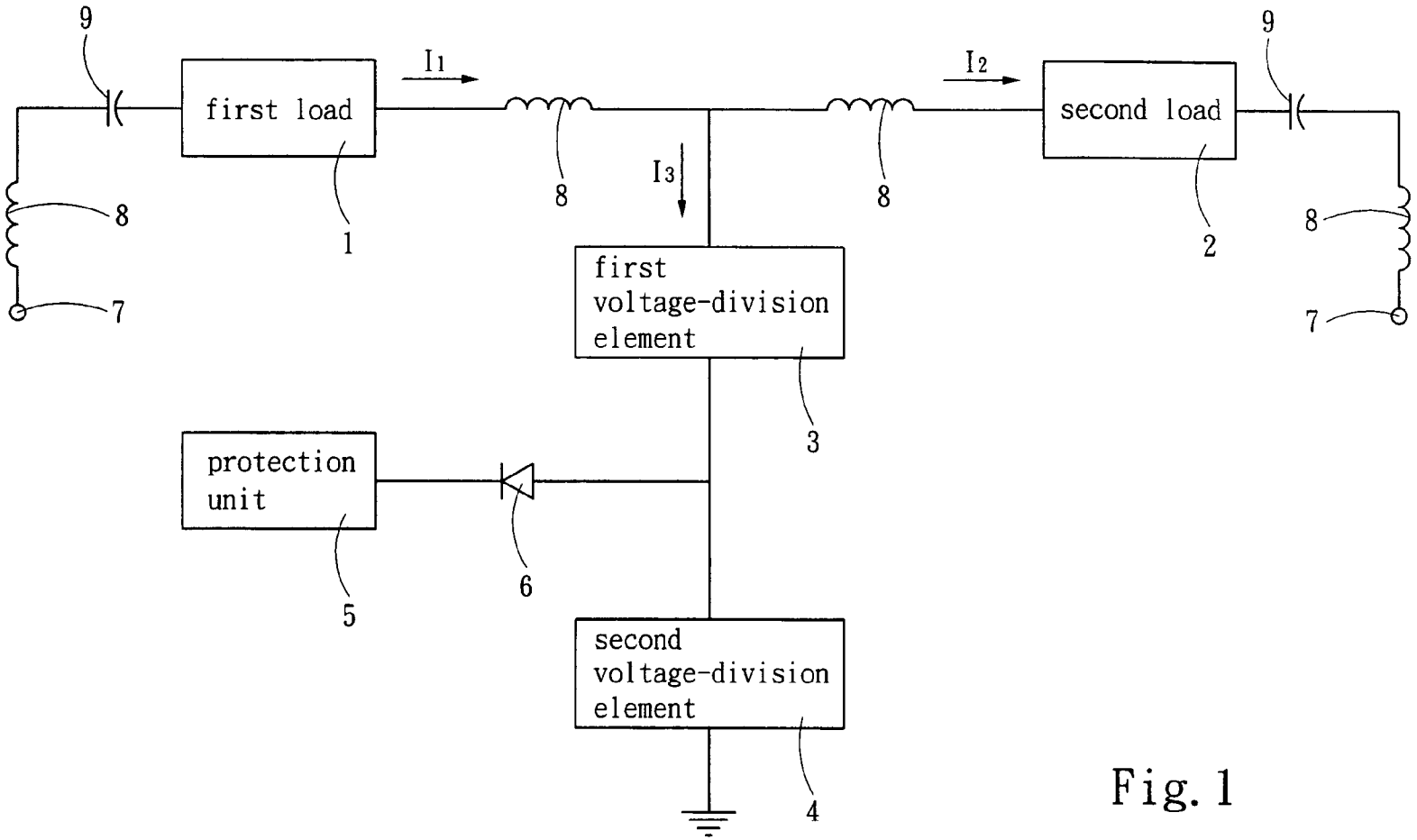
FIG. 1 is a diagram schematically showing the fundamental architecture of the present invention.
Figure 2:
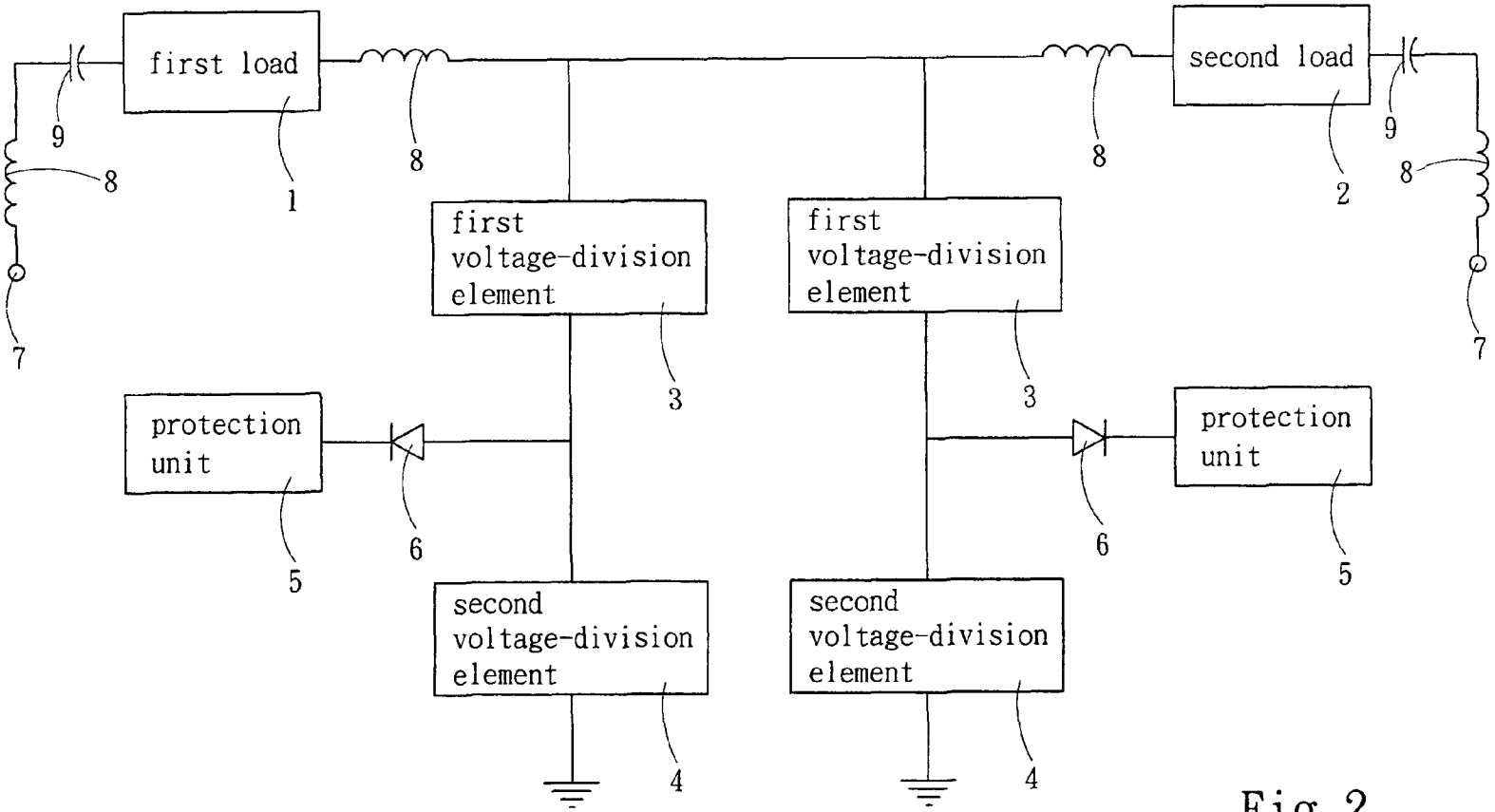
FIG. 2 is a diagram schematically showing an application of the architecture of the present invention.
Figure 3:
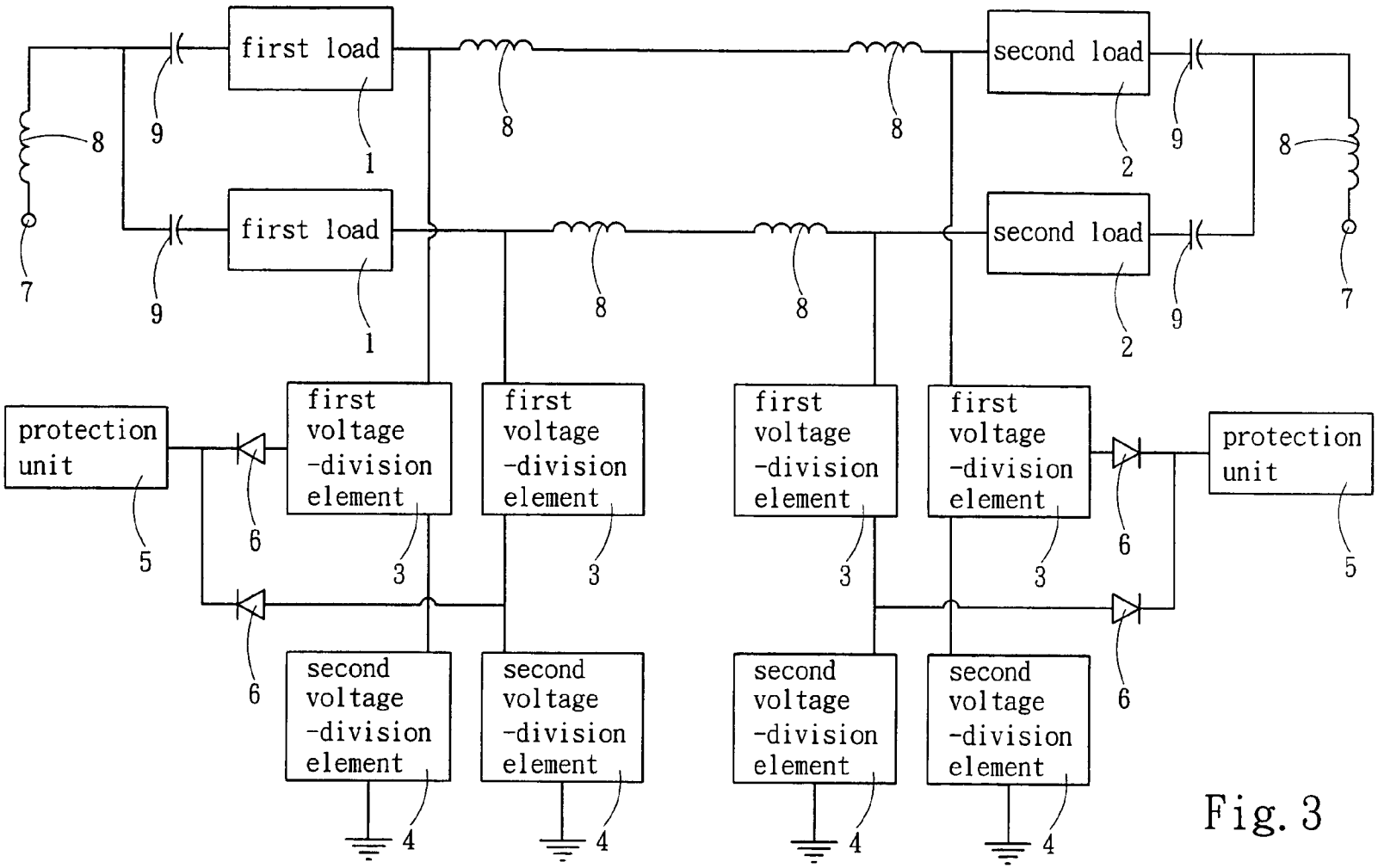
FIG. 3 is a diagram schematically showing an extension of the architecture of the present invention.

Refer to FIG. 1 a diagram schematically showing the fundamental architecture of the present invention. The present invention applies to the driving system 7, which has been described in the prior art. The driving system 7 comprises: a plurality of AC voltage sources outputting several different-phase voltage signals, a multi-phase transformer having a plurality of different-phase coil windings, and a plurality of loads, wherein each loop thereof has at least two opposite-phase loads and a coil winding, and each AC voltage source drives at least one loop. Two opposite-phase loads are separately defined to be a first load 1 and a second load 2, and each of the first load 1 and the second load 2 may be coupled to a inductor 8 or a capacitor 9 to improve the quality of current. The first load 1 and the second load 2 may be connected in series, and there is a 180-degree phase difference between the current I1 flowing through the first load 1 and the current I2 flowing through the second load 2. The present invention is characterized in that a voltage-division/detection loop is coupled to between the first load 1 and the second load 2. The voltage-division/detection loop is formed via cascading a first voltage-division element 3 to a second voltage-division element 4, and the second voltage-division element 4 is connected to a ground terminal. A signal-acquiring terminal is coupled to between the first voltage-division element 3 and the second voltage-division element 4. The signal-acquiring terminal is connected to a diode 6 and a protection unit 5, wherein the diode 6 is used to insure the unidirectional flow of current. As there is a 180-degree phase difference between the current I1 flowing through the first load 1 and the current I2 flowing through the second load 2, as the algebraic sum of the currents entering and leaving a junction should be zero according to the Kirchhoff's current law, the current I1 flowing through the first load 1 should be equal to the current I2 flowing through the second load 2. Therefore, when the driving system 7, the first load 1 and the second load 2 operate normally, the abnormal current I3 flowing to the voltage-division/detection loop will be almost zero, and the protection unit will not work. When the first load 1 is dropped or broken, an evident abnormal current I3 will flow to the voltage-division/detection loop, and the value of the abnormal current I3 is equal to the value of the current I2 flowing through the second load 2 according to the Kirchhoff's current law. The abnormal current I3 flows through the first voltage-division element 3 and the second voltage-division element 4 and creates voltage drop, and the signal-acquiring terminal acquires an abnormal voltage signal from between the first voltage-division element 3 and the second voltage-division element 4. The abnormal voltage signal passes through the diode 6 and then reaches the protection unit 5 to trigger the protection unit 5 to shut off the driving system 7. The protection unit 5 determines the timing of closing the driving system 7 according to the abnormal voltage signal. The signal-acquiring terminal may be coupled to at least one diode 6, and the turn-on voltage of the diode 6 can thus function as the threshold voltage of triggering the protection unit 5 lest the protection unit 5 act falsely because of a slight voltage fluctuation. Refer to FIG. 2. Besides, two or more voltage-division/detection loops may be coupled to between the first load 1 and the second load 2. Refer to FIG. 3. Further, several sets of the first loads 1 and second loads 2 may be connected in parallel, and at least one voltage-division/detection loop having the signal-acquiring terminal is coupled to between each pair of the first load 1 and second load 2, and one protection unit 5 can be connected in parallel to more than one signal-acquiring terminal. Thus, the present invention can also protect a plurality of loads connected in parallel.

Figure 4:
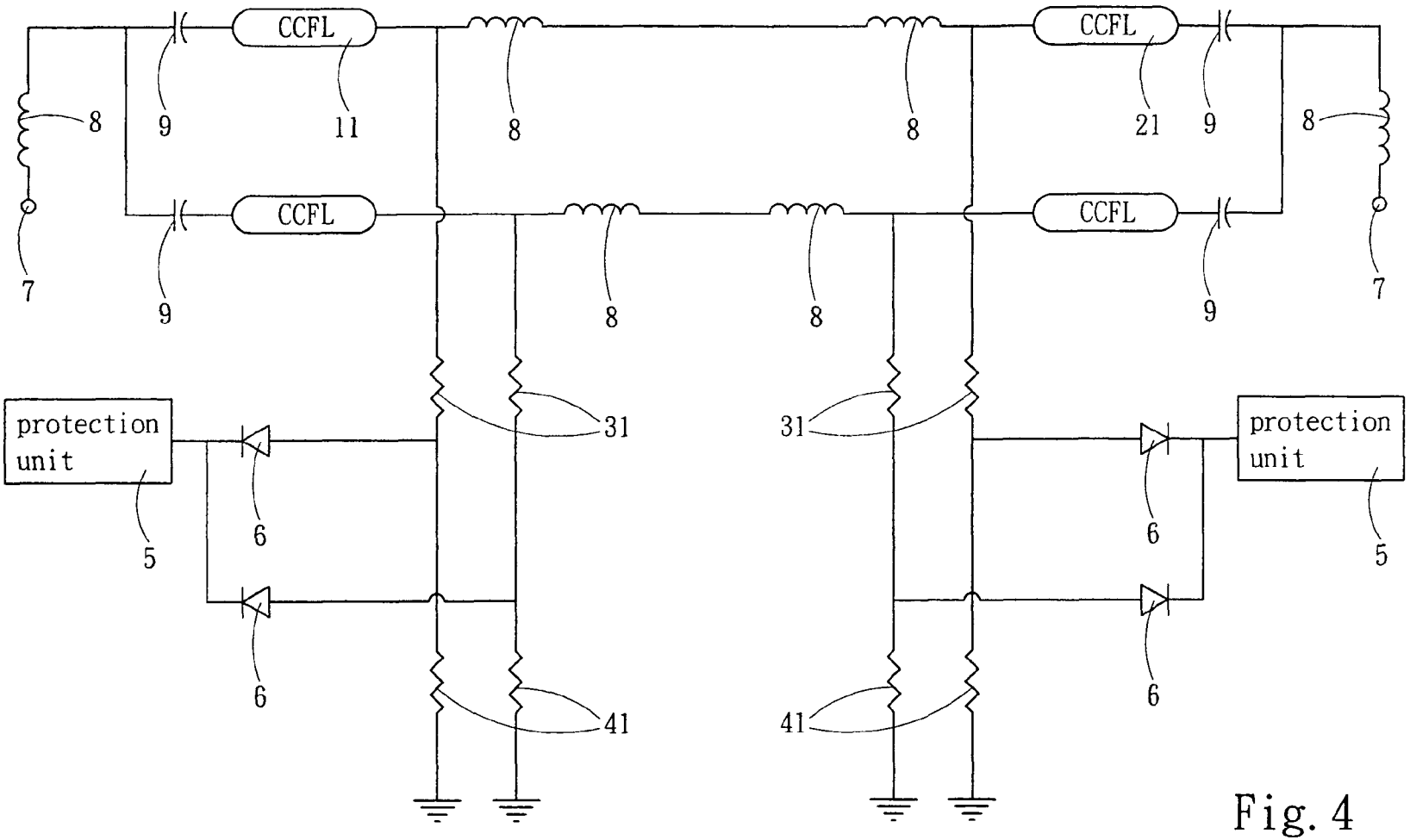
FIG. 4 is a diagram schematically showing an embodiment of the present invention.
Figure 5:
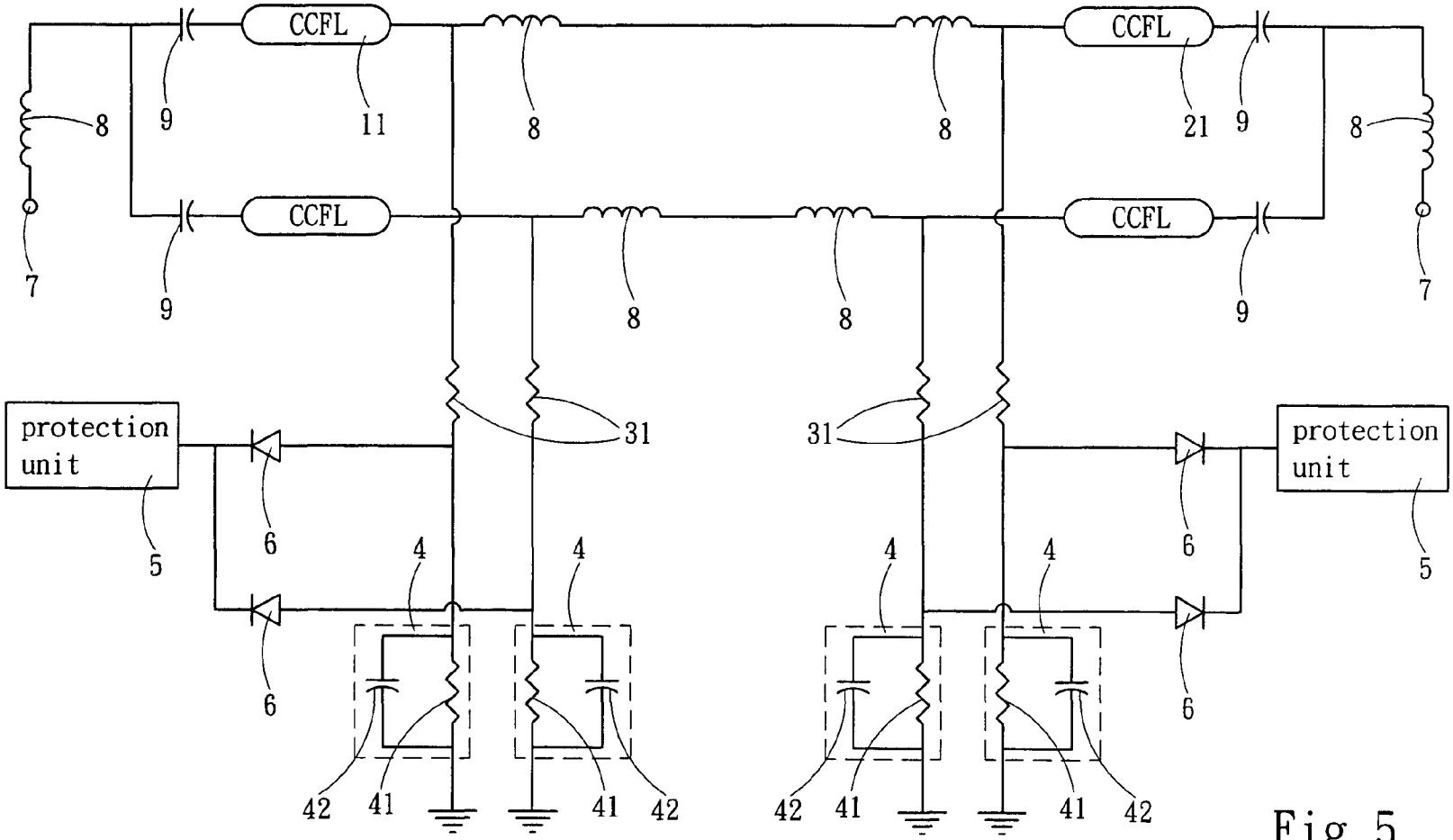
FIG. 5 is a diagram schematically showing another embodiment of the present invention.

Refer to FIG. 4 for an embodiment of the present invention. In this embodiment, the first loads 1/the second loads 2 may be a single lamp 11/21, or several lamps 11/21 connected in series or in parallel, or the combination of the lamps 11/21 connected in series and the lamps 11/21 connected in parallel. The first voltage-division element 3/the second voltage-division element 4 may be a resistor 31/41. Refer to FIG. 5. Alternatively, the first voltage-division element 3/the second voltage-division element 4 may be a resistor 31/a resistor 41 plus a capacitor 42. In fact, the first voltage-division element 3 may also be a resistor plus a capacitor. The abovementioned first voltage-division element 3 and second voltage-division element 4 may have an identical impedance or different impedances. Thus, the architecture of the present invention can indeed protect a multi-lamp circuit and mature a conventional multi-lamp driving system.

The preferred embodiments described above are only to exemplify the present invention but not to limit the scope of the present invention. Any equivalent modification or variation made by the persons skilled in the art according to the spirit of the present invention is to be also included within the scope of the present invention, which is based on the claims stated below.

In conclusion, the improvements of the present invention have been described above, and it proves that the present invention indeed possesses novelty and non-obviousness and meets the conditions for a patent. Thus, the Inventors file the application for a patent. It will be appreciated that the patent of the present invention is approved fast.

What is claimed is:

1. A protection architecture for a multi-lamp system, which applies to a multi-lamp driving system comprising: a plurality of AC voltage sources outputting several different-phase voltage signals, a multi-phase transformer having a plurality of different-phase coil windings, and a plurality of loads, wherein each loop thereof has at least two of said plurality of loads having opposite polarity and one said coil winding, and each of said AC voltage source drives at least one of said loops, and wherein said protection architecture for a multi-lamp system is characterized in that two of said opposite-phase loads are separately defined to be a first load and a second load, and that a voltage-division/detection loop is formed via cascading a first voltage-division element to a second voltage-division element and is coupled to a point between said first load and said second load to acquire an abnormal current indicating that the currents flowing through the first and second loads are not equal, and said second voltage-division element is coupled to a ground terminal, and a signal-acquiring terminal is coupled to between said first voltage-division element and said second voltage-division element and acquires an abnormal voltage signal for a protection unit.

2. The protection architecture for the multi-lamp system according to claim 1, wherein said first load or said second load is a single lamp.

3. The protection architecture for the multi-lamp system according to claim 1, wherein said first load or said second load is a plurality of lamps connected in series.

4. The protection architecture for the multi-lamp system according to claim 1, wherein said first load or said second load is a plurality of lamps connected in parallel.

5. The protection architecture for the multi-lamp system according to claim 1, wherein said first load or said second load is a combination of lamps connected in series and lamps connected in parallel.

6. The protection architecture for the multi-lamp system according to claim 1, wherein either of said first voltage-division element and said second voltage-division element is a resistor.

7. The protection architecture for the multi-lamp system according to claim 6, wherein said first voltage-division element and said second voltage-division element respectively have different impedances.

8. The protection architecture for the multi-lamp system according to claim 6, wherein said first voltage-division element and said second voltage-division element have an identical impedance.

9. The protection architecture for the multi-lamp system according to claim 1, wherein one of said first voltage-division element and said second voltage-division element is a combination of at least one resistor and at least one capacitor.

10. The protection architecture for the multi-lamp system according to claim 9, wherein said first voltage-division element and said second voltage-division element have an identical impedance.

11. The protection architecture for the multi-lamp system according to claim 9, wherein said first voltage-division element and said second voltage-division element respectively have different impedances.

12. The protection architecture for the multi-lamp system according to claim 1, wherein either of said first voltage-division element and said second voltage-division element is a combination of at least one resistor and at least one capacitor.

13. The protection architecture for the multi-lamp system according to claim 12, wherein said first voltage-division element and said second voltage-division element respectively have different impedances.

14. The protection architecture for the multi-lamp system according to claim 12, wherein said first voltage-division element and said second voltage-division element have an identical impedance.

15. The protection architecture for the multi-lamp system according to claim 1, wherein protection unit determines a timing of closing said driving system according to said abnormal voltage signal.

16. The protection architecture for the multi-lamp system according to claim 1, wherein there is a phase difference of 180 degrees between the current flowing through said first load and the current flowing through said second load.

17. The protection architecture for the multi-lamp system according to claim 1, wherein two or more voltage-division/detection loops are coupled to between said first load and said second load.

* * * * *